United States Patent [19]

Miyazako et al.

[11] 4,172,732

[45] Oct. 30, 1979

[54] PHOTOGRAPHIC LIGHT-SENSITIVE MATERIAL

[75] Inventors: Takushi Miyazako; Nobuo Tsuji; Tadao Sugimoto; Kenji Yokoo, all of Minami-ashigara, Japan

[73] Assignee: Fuji Photo Film Co., Ltd., Minami-ashigara, Japan

[21] Appl. No.: 567,025

[22] Filed: Apr. 10, 1975

[30] Foreign Application Priority Data

Apr. 10, 1974 [JP] Japan ..... 49/40699

[51] Int. Cl.[2] ..... G03C 1/72

[52] U.S. Cl. ..... 96/114; 96/87 R

[58] Field of Search ..... 96/114, 87 R

[56] References Cited

U.S. PATENT DOCUMENTS 3,723,127 3/1973 Yano et al. ..... 96/114

3,843,364 10/1974 Florens et al. ..... 96/114

FOREIGN PATENT DOCUMENTS 1137909 12/1968 United Kingdom ..... 96/114

*Primary Examiner*—Jack P. Brammer

*Attorney, Agent, or Firm*—Sughrue, Rothwell, Mion, Zinn and Macpeak

[57] ABSTRACT

A photographic light-sensitive material having a photographic layer containing a copolymer of a styrene component, a maleic acid component and an acrylamide component in which the content of the acrylamide component is about 3 to 30 mol%.

12 Claims, 1 Drawing Figure

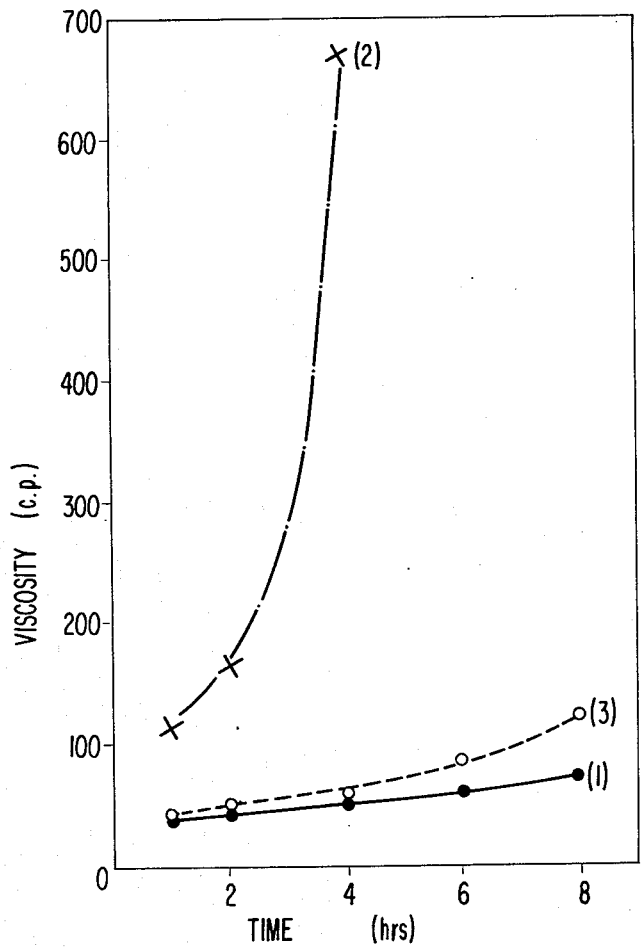
700
600
500
400
300
200
100
0
VISCOSITY (c.p.)
(2)
(3)
(1)
2
4
6
8
TIME (hrs)

PHOTOGRAPHIC LIGHT-SENSITIVE MATERIAL

BACKGROUND OF THE INVENTION

1. Field of the Invention

This invention relates to a photographic light-sensitive material and more particularly, it is concerned with a photographic light-sensitive material having a good film quality.

2. Description of the Prior Art

In the production of photographic light-sensitive materials, it is important to increase the film quality thereof so as to improve the photographic and processing properties. Use of a hardener for gelatin is generally carried out in order to increase the film quality. It is well known as described in Japanese Pat. No. 131,152/1939, *Nihon Shashin Gakkai-shi,* Vol. 28, p. 195 (1965), Japanese Pat. publication No. 38712/1971 and U.S. Pat. No. 3,597,208 that synthetic high molecular materials containing maleic acid increase the quality of films containing gelatin. Furthermore, it is reported in British Pat. No. 1,137,909, German Pat. No. 1,422,810, British Pat. No. 1,124,284 and French Pat. No. 1,240,768 that synthetic high molecular weight materials containing maleic acid not only increase the film quality, but also are effective for increasing the covering power and preventing halation or static charging.

When a synthetic high molecular weight material containing maleic acid (copolymer) is added to gelatin, however, a marked increase in viscosity and, after the passage of time, even a gelation occur. Therefore, maleic acid copolymers have various uses but the practical use thereof is quite limited. In order to solve this problem, it is necessary to suppress completely the increase in the viscosity of an aqueous solution when a maleic acid copolymer and gelatin are mixed as well as the gelation after the passage of time. In particular, a styrene-maleic acid copolymer has a disadvantage that the viscosity increases markedly when this copolymer is mixed with gelatin and gelation is nearly unavoidable after the passage of time.

SUMMARY OF THE INVENTION

An object of the invention is to provide a styrene-maleic acid copolymer that does not cause an increase in viscosity even when mixed with gelatin.

Another object of the invention is to provide a styrene-maleic acid copolymer that does not cause gelation even when mixed with gelatin and the mixture is allowed to stand for a long time.

A further object of the invention is to provide a styrene-maleic acid copolymer that is capable of suppressing the occurrence of reticulation during processing.

A still further object of the invention is to provide a styrene-maleic acid copolymer that is capable of suppressing the occurrence of adhesion of a surface layer by the joint use of a matting agent.

Various studies have been made and as a result it has been found that a copolymer corresponding to a styrene-maleic acid copolymer to which an acrylamide component as a hydrophilic vinyl monomer is added has excellent properties in that the viscosity of a gelatin solution is not increased and the above described objects can be accomplished with this copolymer.

That is to say, this invention comprises a photographic light-sensitive material with a photographic layer thereof containing gelatin and a copolymer of a styrene component, a maleic acid component and an acrylamide component.

BRIEF DESCRIPTION OF THE DRAWINGS

In the FIGURE, Curves (1), (2) and (3) show the viscosity increases of coating solutions for a protective layer using Polymer I solution, Polymer II solution and a gelatin solution respectively, after the passage of time at 40° C., as described in the examples.

DETAILED DESCRIPTION OF THE INVENTION

The copolymer of the invention contains about 3 to 30 mol% of an acrylamide component in addition to a styrene component and a maleic acid component.

The acrylamide component in the copolymer of the invention includes a monomer represented by the following general formula (I),

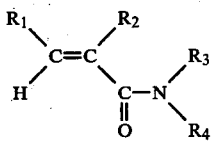

(I)

in which $R_1$ and $R_2$, which can be the same or different, each represents a hydrogen atom and a methyl group and $R_3$ and $R_4$, which can be the same or different, each represents a hydrogen atom, a substituted or unsubstituted alkyl group having 1 to 8 carbon atoms and may combine as the non-metallic atoms necessary for forming a 5-, 6-, or 7-membered ring.

In General Formula (I), the alkyl groups $R_3$ and $R_4$ can be substituted with substituents such as hydroxyl, alkoxy and oxo groups (e.g., methyl, ethyl, butyl, tert-butyl, hexyl, cyclohexyl, octyl, hydroxyethyl, methoxyethyl, 1,1-dimethyl-3-hydroxybutyl, 1,1-dimethyl-3-oxobutyl, hydroxyethoxyethyl, etc.). $R_3$ and $R_4$ are non-metallic atoms necessary for forming 5-, 6- or 7-membered rings, chosen from carbon, oxygen and nitrogen atoms, (e.g., morpholino, N-methylpiperazino, piperidino, pyrrolidino, hexamethyleneimino, etc.). The total number carbon atoms of $R_3$ and $R_4$ is generally about 15 or less, preferably 11 or less, since if the number of carbon atoms is higher than about 15, the hydrophilic property of the copolymer is often lowered.

Examples of monomers for the acrylamide component which can be used in the copolymer of the invention are acrylamide, methacrylamide, N-methylacrylamide, N-ethylacrylamide, N,N-dimethylacrylamide, N,N-diethylacrylamide, N,N-dibutylacrylamide, N-methylolacrylamide, N-hydroxyethylacrylamide, N-acryloylpiperidine, N-acryloylhexamethyleneimine, N-acryloylpyrrolidine, N-tert-butylacrylamide, N-heptylacrylamide, N-octylacrylamide, N-methylmethacrylamide, N-ethylmethacrylamide, N-tert-butylmethacrylamide, N-2-ethylhexylacrylamide, 1,1-dimethyl-3-oxobutylacrylamide, 1,1-dimethyl-3-oxobutylmethacrylamide, N-methylolmethacrylamide, N-hydroxyethylmethacrylamide, N-(methoxyethyl)acrylamide, N-methacryloylmorpholine, N-acryloyl-N-methyl(piperazine), crotonamide and itaconamide.

Of these monomers, acrylamide, methacrylamide, N,N-dimethylacrylamide, N,N-diethylacrylamide, 1,1-dimethyl-3-oxobutylacrylamide and N-tert-butylacrylamide are particularly preferred because of their ease of reaction and their ready availability.

The styrene component in the copolymer of the invention includes a monomer represented by the following general formula (II),

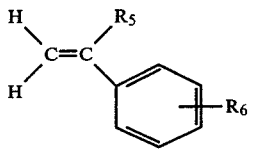

(II)

in which $R_5$ represents a hydrogen atom or a methyl group and $R_6$ represents a hydrogen atom, an alkyl group having 1 to 4 carbon atoms (e.g., ethyl, isopropyl, tert-butyl, etc.), an alkoxy group having 1 to 4 carbon atoms (e.g., methoxy, ethoxy, butoxy, etc.), a hydroxyl group, a hydroxymethyl group, a cyano group, a nitro group or a halogen atom (e.g., chlorine, etc.).

Examples of monomers for the styrene component which can be used in the copolymer of the invention are styrene, α-methylstyrene, vinyltoluene, ethylstyrene, methoxystyrene, hydroxystyrene, chlorostyrene, bromostyrene, fluorostyrene and acetoxystyrene, Of these monomers, styrene, α-methylstyrene and vinyltoluene are particularly preferred.

The maleic acid component used in the copolymer of the invention includes a monomer represented by the following general formula (III),

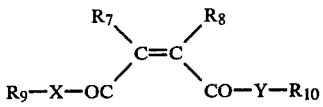

(III)

in which $R_7$ and $R_8$, which can be the same or different, each represents a hydrogen atom, a methyl group or a phenyl group, $R_9$ and $R_{10}$ which can be the same or different, each represents a hydrogen atom, an alkyl group having 1 to 12 carbon atoms or an aralkyl group having 1 to 3 carbon atoms in the alkyl moiety, and X and Y, which can be the same or different, each represents —O— and —NH— or —X—$R_9$ and —Y—$R_{10}$ can combine and represent —O— (e.g., form an anhydride ring).

Examples of monomers of the maleic acid component are maleic anhydride, maleic acid, α-phenylmaleic anhydride, chloromaleic acid, fumaric acid, citraconic anhydride, citraconic acid, dimethylmaleic acid, monomethyl maleate and maleamic acid. Of these monomers, maleic anhydride, maleic acid, α-phenylmaleic anhydride and monomethyl maleate are particularly preferred because of their reactivity.

The copolymer of the invention containing a styrene component, a maleic acid component and an acrylamide component does not cause an increase in viscosity when mixed with an aqueous solution of gelatin. This phenomenon is a very important discovery which has not been found in styrene-maleic acid copolymers, i.e., which is unexpected from conventional knowledge of polymerization products, for example, the degree of polymerization and the monomer composition ratio. The content of the acrylamide in the copolymer of styrene-maleic acid-acrylamide is preferably about 3 to 30 mol%, particularly 7 to 20mol%, since if less than about 3 mol% is present, the effect of suppressing a rapid increase in viscosity of a gelatin solution is slight, while if more than about 30 mol% is present, the film forming property is decreased. The contents of the styrene component and maleic acid component are not particularly limited, but the content of the maleic acid component is generally about 35 to 50 mol%.

The styrene-maleic acid-acrylamide copolymer of the present invention can be readily synthesized in a conventional manner, that is, by polymerizing the corresponding monomers using conventional techniques. Organic solvents, either individually or in combination, such as dioxane, acetonitrile, tetrahydrofuran, acetone, methanol, isopropanol, butanol, hexane, petroleum ether, methyl acetate, butyl acetate, ethyl acetate, methyl ethyl ketone, dimethylformamide and formamide can be used as the reaction solvent. Any organic peroxides such as azobisisobutyronitrile, butyronitrile and benzoyl peroxide can be used as the polymerization catalyst.

The polymerization is ordinarily carried out using a solvent in a proportion of about 5 to 500% by weight, preferably 50 to 200% by weight, and a polymerization catalyst in a proportion of about 0.1 to 10% by weight, preferably, 0.5 to 3% by weight. The reaction can be carried out by charging the monomers, a solvent and a polymerization catalyst in a reactor followed by replacing the air with nitrogen, keeping the reaction temperature at about 50° to 90° C., preferably, 70° to 80° C. and stirring the mixture for about 2 to 10 hours, preferably, 4 to 7 hours.

The thus obtained product is precipitated in a copolymer-insoluble solvent such as water or hexane and dried. If desired, the polymer can be used in a water soluble condition by reaction with ammonia, lithium hydroxide, sodium hydroxide or potassium hydroxide. During the polymerization reaction, other monomers (e.g., in an amount up to about 5 mol% or less) such as methyl acrylate, methyl methacrylate, ethyl acrylate, butyl acrylate, butyl methacrylate, glycidyl methacrylate, 2-ethylhexyl methacrylate, acrylontrile and methyl crotonate can be used. The copolymer of the present invention has a molecular weight of about 1,000 to 1,000,000, preferably 5,000 to 100,000. The copolymer of the invention can be used for photographic layers in a photographic light-sensitive material, for example, a protective layer, an emulsion layer, a filter layer, an intermediate layer, an antihalation layer, a back layer and other auxiliary layers.

The copolymer of the invention can be used with gelatin (including graft gelatin) in an optional proportion, but the proportion to gelatin is preferably about 3 to 60% by weight, particularly 5 to 30% by weight. Furthermore, other natural or synthetic high molecular weight materials can be added. The copolymer of the invention can be used alone. Examples of suitable hardeners which can be employed where gelatin is used are aldehyde compounds such as formaldehyde and glutaraldehyde, ketone compounds such as diacetyl and cyclopentadione, compounds having reactive halogens such as bis(2-chloroethylurea), 2-hydroxy-4,6-dichloro-1,3,5-triazine and others described in U.S. Pat. Nos. 3,288,775 and 2,732,303 and British Pat. Nos. 974,723 and 1,167,207, compounds having reactive olefins such as divinyl sulfone, 5-acetyl-1,3-diacryloylhexahydro-1,3,5-triazine and others described in U.S. Pat. Nos. 3,635,718 and 3,232,763 and Brit. Patent No. 994,869, N-methylol compounds such as N-hydroxymethylphthalimide and others described in U.S. Pat. Nos. 2,732,316 and 2,586,168, isocyanate compounds such as described in U.S. Pat. No. 3,103,437, aziridine compounds such as described in U.S. Pat. Nos. 3,017,280 and 2,983,611, acid derivatives such as described in U.S. Pat. Nos. 2,725,294 and 2,725,295, carbodiimide compounds such as described in U.S. Pat. No. 3,100,704, epoxy compounds such as described in U.S. Pat. No. 3,091,537, isoxazole compounds such as described in U.S. Pat. Nos. 3,321,313 and 3,543,292, halocarboxyaldehydes such as mucochloric acid, dioxane derivatives such as dihydroxydioxane and dichlorodioxane and inorganic hardeners such as chrome alum and zirconium sulfate.

A photographic layer containing the copolymer of the invention, for example, a protective layer, an emulsion layer, an intermediate layer, a back layer, a filter layer or an antihalation layer can be coated onto a support such as a cellulose acetate film, a cellulose acetate butyrate film, a cellulose acetate propionate film, a polystyrene film, a polyethylene terephthalate film, a polycarbonate film, laminates of these films, thin glass films and papers. Furthermore, papers coated or laminated with baryta or α-olefin polymers, in particular, polymers of α-olefins having 2 to 10 carbon atoms, such as polyethylene, polypropylene and ethylene-butene copolymers, and synthetic resin films surface-roughened to increase the adhesiveness to other high molecular weight materials as well as printing properties, as disclosed in Japanese Pat. publication No. 19068/1972 can be used as such a support. The coating can be carried out using any conventional coating method, for example, by dip coating, air knife coating, curtain coating or extrusion coating using a hopper described in U.S. Pat. No. 2,681,294. As the occasion demands, two or more layers can simultaneously be coated using the method described in U.S. Pat. Nos. 2,761,791, 3,508,947, 2,941.898 and 3,526,528.

When the copolymer of the invention is used for a protective layer in combination with a matting agent, the adhesion resistance is remarkably increased. The matting agent used herein has a diameter of, preferably, about 0.3 to 10 microns, particularly 0.5 to 5 microns. Useful examples of matting agents are silver halides such as silver bromide, glass beads, silica, zinc carbonate, cadmium carbonate, titanium oxide, strontium barium sulfate, strontium sulfate, barium sulfate, methyl polymethacrylate, polystyrene, polydivinylbenzene, polyacrylonitrile, polytetrachloroethylene, polycarbonate, polyvinylidene chloride, poly-α-methylstyrene, cellulose acetate propionate, fatty acids and starch. Of these, silver halides, barium sulfate, strontium sulfate, silica, methyl polymethacrylate and polystyrene are preferably used. The quantity of such a matting agent is about 0.1 to 10% by weight, preferably 0.5 to 3% by weight based on the total binder weight.

Examples of suitable surfactants which can be used as a coating aid during the coating are natural surfactants such as saponin, nonionic surfactants such as those of the alkylene oxide type, glycerin type and glycidol type, cationic surfactants such as higher alkylamines, quaternary ammonium salts and heterocyclic compounds such as pyridine and phosphonium or sulfonium compounds, anionic surfactants containing acidic groups such as carboxylic acid, sulfonic acid, phosphoric acid, sulfuric acid ester and phosphoric acid ester groups and amphoteric surface active agents such as aminoacids, aminosulfonic acids and sulfuric acid or phosphoric acid esters of amino alcohols. Some examples of these surfactants which can be used are also described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, DOS No. 1,942,665, British Pat. Nos. 1,077,317 and 1,198,450, Ryohei Oda, et al., *Kaimen Kasseizai No Gosei To Sono Oyo* (*Synthesis and Application of Surface Active Agents*) (1964), A. W. Perry, *Surface Active Agents* Interscience Publications Inc., (1958) and J. P. Sisley, *Encyclopedia of Surface Active Agents*, Vol. 2 Chemical Publishing Co., (1964).

Examples of suitable antistatic agents which can be used in the present invention are disclosed in U.S. Pat. Nos. 2,139,778, 2,279,410, 2,322,037, 2,331,739, 2,386,627, 2,494,054, 2,972,535, 2,973,536, 3,017,388, 3,033,679, 3,133,047, 3,201,251, 3,206,312, 3,262,807 and 3,437,484, British Pat. Nos. 1,054,776 and 1,106,618 and U.S. Pat. Nos. 2,882,157, 2,639,234 and 2,972,538.

The quantity of a copolymer to be added to gelatin can markedly be increased according to the present invention, since the copolymer of the invention, used as described above, has the surprising effect of not increasing the viscosity when mixed with gelatin. When the copolymer is added to gelatin, moreover, no gelation takes place even after the passage of time and, therefore, the styrene-maleic acid-acrylamide copolymer of the invention can be employed industrially. Furthermore, the use of the copolymer of the invention results in, particularly, suppressing the occurrence of reticulation in high temperature treatment. When the copolymer of the invention is used with a matting agent in a protective layer, the adhesion resistance can be markedly improved. Photographic materials in which the copolymer of the invention is used exhibit an improved antistatic property, adhesiveness and scratch resistance.

The copolymer of the invention is applicable to photographic layers of various light-sensitive materials, for example, color negative films, color positive films, color papers, direct positives, direct color positives, diffusion transfer color photographic materials, diffusion transfer photographic materials, X-ray films and lithographic light-sensitive materials.

The following synthesis examples and examples are given in order to illustrate the invention in greater detail without limiting the invention. Unless otherwise indicated herein, all parts, percents, ratios and the like are by weight.

SYNTHESIS EXAMPLE 1

(Synthetic High Molecular Weight Material A)

83.2 g (0.8 mol) of styrene, 92.8 g (0.8 mol) of maleic acid, 28.4 g (0.4 mol) of acrylamide, 200 ml of dioxane and 2.0 g of benzoyl peroxide as a polymerization catalyst were charged in a reactor, the reactor purged with nitrogen and the mixture was stirred at 70° to 80° C. for 6 hours. The resulting product was precipitated in water and dried. Yield: 163.4 g (79.9%). Then the product was neutralized with sodium hydroxide to obtain an aqueous solution having a pH of 7.0. The reduced specific viscosity measured at 30° C. was 0.15 (0.1% in $H_2O$).

SYNTHESIS EXAMPLE 2

(Synthetic High Molecular Weight Material B)

94.4 g (0.8 mol) of vinyltoluene (p:m isomer ratio=65:35), 130 g (1.0 mol) of monomethyl maleate, 14.2 g (0.2 mol) of acrylamide, 100 ml of acetone, 100 ml of isopropanol and 2.4 g of benzoyl peroxide as a polymerization catalyst were charged in a reactor, the reactor purged with nitrogen and the mixture was stirred at 70° to 80° C. for 7 hours. The product was precipitated in water and dried. Yield: 179 g (75.0%). Then the product was neutralized with sodium hydroxide to obtain an aqueous solution having a pH of 7.0 and concentration of 10%. The reduced specific viscosity measured at 30° C. was 0.21 (0.1% in $H_2O$).

SYNTHESIS EXAMPLE 3

(Synthetic High Molecular Weight Material C)

104 g (1.0 mol) of styrene, 98.6 g (0.85 mol) of maleic acid, 19 g (0.15 mol) of tert-butylacrylamide, 200 ml of dioxane and 3.0 g of benzoyl peroxide as a polymerization catalyst were charged in a reactor, the reactor purged with nitrogen and the mixture was stirred at 80° to 90° C. for 6 hours. The product was precipitated in water and dried. Yield: 175 g (80.3%). Then the product was neutralized with sodium hydroxide to obtain a 10% aqueous solution having a pH of 7.0. The reduced specific viscosity measured at 30° C. was 0.26.

SYNTHESIS EXAMPLE 4

(Synthetic High Molecular Weight Material D)

104 g (1.0 mol) of styrene, 104.4 g (0.9 mol) of maleic acid, 16.9 g (0.1 mol) of diacetone acrylamide, 230 ml of dioxane and 3.0 g of benzoyl peroxide as a polymerization catalyst were charged in a reactor, the reactor purged with nitrogen and the mixture was stirred at 80° to 90° C. for 6 hours. The product was precipitated in water and dried. Yield: 201 g (89.3%). Then the product was neutralized with sodium hydroxide to obtain a 10% aqueous solution having a pH of 7.0. The reduced specific viscosity measured at 30° C. was 0.23.

SYNTHESIS EXAMPLE 5

(Comparison Synthetic High Molecular Weight Material E)

104 g (1.0 mol) of styrene, 116 g (1.0 mol) of maleic acid, 200 ml of dioxane and 3.0 g of benzoyl peroxide as a polymerization catalyst were charged in a reactor, the reactor purged with nitrogen and the mixture was stirred at 80° to 90° C. for 6 hours. The product was precipitated in water and dried. Yield: 203 g (92.3%). Then, the product was neutralized with sodium hydroxide to obtain a 10% aqueous solution having a pH of 7.0. The reduced specific viscosity measured at 30° C. was 0.39.

EXAMPLE 1

Five coating liquids each having the composition as shown in Table 1 were prepared as a coating liquid for a protective layer, stirred adequately at 38° C. and allowed to stand for 24 hours. Thereafter, the viscosity increase of the each coating liquid was measured. Consequently, in the coating liquid using Comparison High Molecular weight Material E outside the present invention, the viscosity during mixing was too high and gelation took place after the passage of time, while in the coating liquids III, IV and V using Synthetic High Molecular Weight Materials A, B and C according to the invention, scarcely any increase in viscosity was observed and the viscosity was substantially similar to that of the coating liquid I as a control. Furthermore, it was found that even if a hardener were used, an increase of viscosity after the passage of time did not occur with the coating liquid using the synthetic high molecular weight material of the invention and the coating property was not deteriorated.

Table 1

| Composition | | Coating Liquid I (Control) | II | III | IV | V |
|---|---|---|---|---|---|---|
| Gelatin (g) | | 100 | 80 | " | " | " |
| Synthetic High Molecular Weight Material | E (g) | — | 20 | — | — | — |
| " | A (g) | — | — | 20 | — | — |
| " | B (g) | — | — | — | 20 | — |
| " | C (g) | — | — | — | — | 20 |
| Hardener-1 (g) | | 1 | " | " | " | " |
| Coating Aid-1 (g) | | 4 | " | " | " | " |
| Water (liter) | | 2 | " | " | " | " |
| Viscosity During Mixing (cps) | | 18 | 81 | 23 | 21 | 26 |
| Viscosity After 24 Hours (cps) | | 27 | Gelation | 31 | 31 | 34 |

Note:

Hardener-1:Sodium Cyanurate

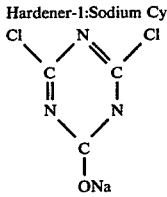

Coating Aid-1:Sodium Diisopropylnaphthalenesulfonate

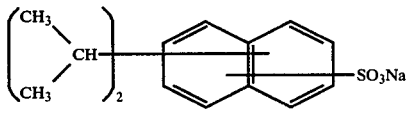

EXAMPLE 2

To a cellulose triacetate support were applied in order a blue-sensitive silver halide emulsion layer A, a gelatin intermediate layer, a red-sensitive silver halide emulsion layer B, a gelatin intermediate layer, a green-sensitive silver halide emulsion layer C and a gelatin protective layer using Liquid I of Example 1 from the support and dried to prepare a Sample I having six layers. The dried thicknesses of these layers were 4.0, 0.5, 4.0, 1.0, 2.5 and 0.5 micron, respectively. Moreover, Samples II and III each having a protective layer were prepared using Liquids IV and V of Example 1 in place of Liquid I.

Blue-Sensitive Silver Halide Emulsion A:

A silver halide photographic emulsion of high sensitivity silver iodobromide containing 0.4 mol% of iodide (0.06 mol of silver and 10 g of gelatin per 100 g) subjected to a second ripening using sodium thiosulfate, the sulfur compound described in U.S. Pat. No. 1,574,944 and potassium chloroaurate as a chemical sensitizer was prepared and mixed with a dispersion of a solution of a yellow dye forming coupler having the following structure

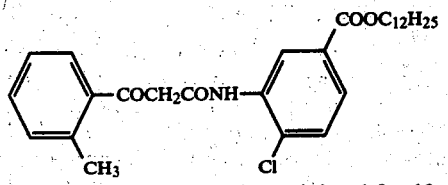

in 10 ml of dibutyl phthalate (containing $1.3\times10^{-2}$ mol of the coupler), dispersed in 90 ml of a 2% aqueous solution of gelatin, so as to provide a coupler: Ag molar ratio of 1:5. Then a hardener (5 ml of a 20% sodium cyanurate aqueous solution to 100 g of gelatin) and a coating aid (6 ml of a 5% sodium diisopropylnaphthalenesulfonate aqueous solution to 100 g of gelatin) were added thereto to prepare a coating liquid.

Red-Sensitive Silver Halide Emulsion B:

A silver halide gelatino photographic emulsion comprising fine particles of silver chlorobromide containing 40 mol% of bromide (0.06 mol of silver and 10 g of gelatin per 100 g) was prepared and mixed with a spectral sensitizing dye having the following structure

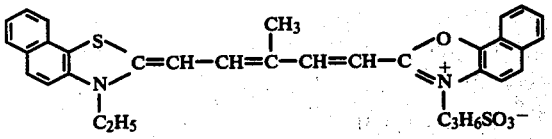

so as to sensitize spectrally and to have a sensitivity maximum at about 685 mμ. Then a dispersion of a dibutyl phthalate solution of a compound having the following structure

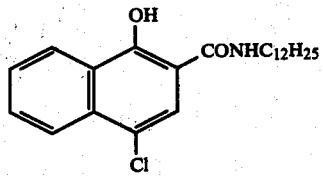

as a cyan dye forming coupler, dispersed in a aqueous solution of gelatin was added thereto to provide a coupler:Ag molar ratio of 1:3, followed by adding the same hardener and coating aid as used in Blue-Sensitive Silver Halide Emulsion A, thus obtaining a coating liquid.

Green-Sensitive Silver Halide Emulsion C:

A silver halide gelatino photographic emulsion comprising fine particles of silver chlorobromide containing 35 mol% of bromide (0.08 mol of silver and 10 g of gelatin per 100 g) was prepared in an analogous manner to Red-Sensitive Silver Halide Emulsion B, and mixed with a spectrally sensitizing dye having the following structure so as to sensitize spectrally and to have a sensitization maximum at about 555 mμ.

Spectral Sensitizing Dye

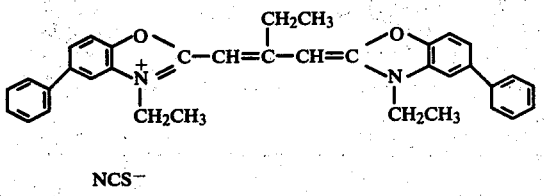

Then a dispersion of a tricresyl phosphate solution of a magenta dye forming coupler having the following structure dispersed in a 2% aqueous solution of gelatin was added thereto to provide a coupler:Ag molar ratio of 1:6, followed by adding the same hardener and coating aid as those used in Blue-Sensitive Silver Halide Emulsion A, thus obtaining a coating liquid.

Magenta Dye Forming Coupler

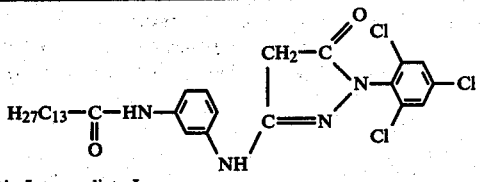

Gelatin Intermediate Layer:

A coating composition as follows was employed.

| | |
|---|---|
| 10% Aqueous Solution of Gelatin | 1.0 Kg |
| 2% Sodium Cyanurate | 50 ml |
| 5% Sodium Diisopropylnaphthalenesulfonate | 60 ml |

The resulting Samples I, II and III were subjected to the following processings at 38° C., dried naturally and the surface conditions were observed using a microscope.

Processing at 38° C.

| Processing Step | Time | Temperature |
|---|---|---|
| Color Development | 1'30" | 38° C. |
| Stopping and Fixing | 40" | " |
| Water Washing | 60" | " |
| Bleaching and Fixing | 40" | " |
| Water Washing | 80" | " |
| Stabilizing | 10" | " |

Color Developer Solution

| | |
|---|---|
| Water | 800 ml |
| Sodium Hexametaphosphate | 2 g |
| Sodium Sulfite (anhydrous) | 4 g |
| 4-Amino-2-Methyl-N,N-Diethylaniline Hydrochloride | 3 g |
| Sodium Carbonate (monohydrate) | 20 g |
| Potassium Bromide | 2 g |

-continued

| Processing at 38° C. | |
|---|---|
| Water | to 1000 ml |
| Stopping and Fixing Solution | |
| Water | 600 ml |
| Sodium Thiosulfate | 240 g |
| Sodium Sulfite (anhydrous) | 15 g |
| Glacial Acetic Acid | 48 ml |
| Boric Acid | 7.5 g |
| Potassium Alum | 15 g |
| Water | to 1000 ml |
| Bleaching and Fixing Solution | |
| Water | 600 ml |
| Ferric Sodium Ethylenediamine-4-Acetate | 60 g |
| Sodium Sulfite (anhydrous) | 12 g |
| Ammonium Thiosulfate (60% aq.soln.) | 200 ml |
| Tetrasodium Ethylenediamine-4-Acetate | 6.7 g |
| Ammonium Thiocyanate | 12 g |
| Water | to 1000 ml |
| Stabilizing Solution | |
| Formalin (37%) | 15 ml |
| Polyethylene Glycol (40%) (Molecular Weight: 400) | 2 ml |
| Water | to 1000 ml |

In Sample I, as a control, a marked occurrence of reticulation was found, while in Samples II and III, there was no reticulation.

It is apparent from this result that the reticulation often occurring in high temperature, rapid treatments can effectively be prevented by the use of a protective layer using Synthetic High Molecular Weight Material B or C of the present invention.

EXAMPLE 3

A blue-sensitive silver halide emulsion layer, green-sensitive silver halide emulsion layer, red-sensitive silver halide emulsion layer, a protective layer having the composition as shown in Table 2, a layer containing a dispersion of an ultraviolet absorbent and an intermediate layer comprising a gelatin solution were coated onto a cellulose acetate support in the order of, from incident light of exposure, the protective layer, the red-sensitive silver halide emulsion layer, the ultraviolet absorbing layer, the green-sensitive silver halide emulsion layer, the intermediate layer and the blue-sensitive silver halide emulsion layer to produce respectively a film thickness on dry basis of 1.0, 2.0, 2.0, 2.5, 1 and 2.5 microns, the blue-sensitive silver halide emulsion layer being obtained by adding 50 g of an emulsified dispersion containing Coupler (1) (coupler $1.2\times10^{-2}$ mol/dispersion 100 g), a hardener (2,4,6-triethyleneimino-1,3,5-triazine: $2.0\times10^{-3}$ mol), a coating aid (Coating Aid-1 of Example 1 $2.8\times10^{-4}$ mol) and 5-methyl-7-hydroxy-2,3,4-triazaindolizine ($8.5\times10^{-2}$ mol) in 100 g of a silver chlorobromide emulsion (AgBr 80 mol%, gelatin 120 g/Ag 1 mol, Ag 0.06 mol/100 g emulsion), the green-sensitive silver halide emulsion layer being obtained by adding 70 g of an emulsified dispersion containing Coupler (2) (coupler $1.3\times10^{-2}$ mol/100 g dispersion), a light-sensitive dye (sodium salt of anhydro-3,3'-di(γ-sulfopropyl)-5,5'-diphenyl-9-ethylcarbocyanine hydroxide: $6.6\times10^{-6}$ mol), a hardener (2,4,6-triethyleneimino-1,3,5-triazine: $1.8\times10^{-3}$ mol) and a coating aid (Coating Aid-1 of Example 1 $3.0\times10^{-4}$ mol) to 100 g of a silver chlorobromide emulsion (AgBr 70 mol%), gelatin 170 g/Ag×1 mol, Ag 0.06 mol/emulsion 100 g) and the red-sensitive silver halide emulsion layer being obtained by adding 150 g of an emulsified dispersion containing Coupler (3) (coupler $1.6\times10^{-2}$ mol/dispersion 100 g), light-sensitive dye (anhydro-3,3-di(4-sulfobutyl)-5,5',6,6'-tetramethylthiacarbocyanine hydroxide $1.0\times10^{-6}$ mol), a hardener (2,4,6-triethyleneimino-1,3,5-triazine $3.0\times10^{-3}$ mol) and a coating aid ($4.0\times10^{-4}$ mol) to 100 g of a silver chlorobromide emulsion (AgBr 70 mol%, gelatin 170 g/Ag 1 mol, Ag 0.06 mol/emulsion 100 g).

Coupler (1)

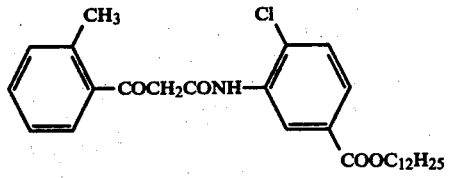

Coupler (2)

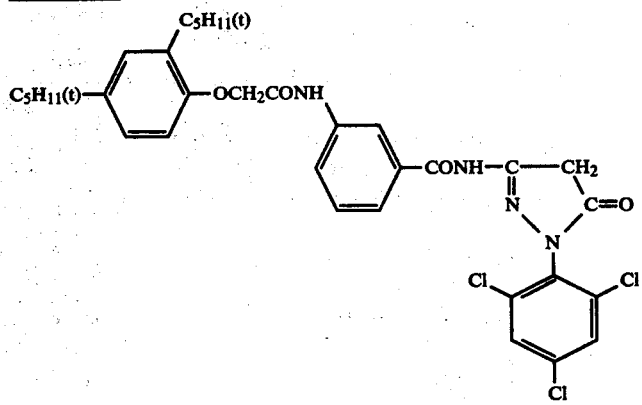

Coupler (3)

-continued

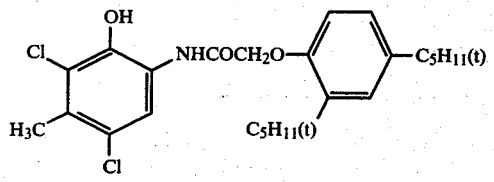

Table 2

| | Composition of Protective Layer | | |
|---|---|---|---|
| | Sample-1 | Sample-2 | Sample-3 |
| Gelatin Solution (10%) | 80 g | 80 g | 100 g |
| Polymer I Solution (Synthetic High Molecular Weight Material D) | 20 g | — | — |
| Polymer II Solution (Synthetic High Molecular Weight Material E) | — | 20 g | — |
| 2,4,6-Triethyleneimino-1,3,5-triazine | $1.6\times10^{-3}$mol | $1.6\times10^{-3}$mol | $2.0\times10^{-3}$mol |
| Sodium Diisopropylnaphthalene-sulfonate | $2.0\times10^{-4}$mol | $2.0\times10^{-4}$mol | $2.0\times10^{-4}$mol |

Each of the protective layer solution used for Samples 1, 2, and 3 was held at 40° C. and the increase in viscosity after the passage of time was measured to obtain the results shown in the FIGURE. In the case of the Polymer (II) solution using Synthetic High Molecular Weight Material E for comparison, the viscosity increased rapidly after 24 hours, followed by gelation, while in the case of the Polymer (II) solution using Synthetic High Molecular Weight Material D of the invention, the viscosity was hardly changed after the passage of time and was substantially constant. (Curves (1), (2) and (3) in FIGURE show the viscosity increases after the passage of time of the protective layer solutions using the Polymer (I) solution, the Polymer (II) solution and a gelatin solution (40° C.).)

Samples 1 to 3 after being coated and dried were allowed to stand at 25° C. and a relative humidity of 60% for 7 days. Then development for a color printing paper was carried out as described below.

| | Time | Temperature |
|---|---|---|
| Color Development | 3'30" | 31° C. |
| Stopping Solution | 30" | " |
| Bleaching and Fixing | 1'30" | " |
| Water Washing | 1' | " |
| Stabilizing | 1' | " |
| Rinsing | 5" | " |
| Drying | | |

The compositions of the processing solutions used were as follows:

| | |
|---|---|
| Color Developer | |
| Benzyl Alcohol | 12 ml |
| Diethylene Gylcol | 3.5 ml |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfate | 2.0 g |
| Disodium Ethylenediaminetetra-acetate Dihydrate | 2.0 g |
| 4-Amino-3-Methyl-N-Ethyl-N-(β-Methanesulfonamideethyl)Aniline Sesquisulfate Monohydrate | 5.0 g |

-continued

| | |
|---|---|
| Water | to 1000 ml |
| Stopping Solution | |
| Sodium Thiosulfate | 10 g |
| Ammonium Thiosulfate (70% aq. soln.) | 30 ml |
| Sodium Acetate | 5 g |
| Acetic Acid | 30 ml |
| Potassium Alum | 15 g |
| Water | to 1000 ml |
| Bleaching and Fixing Solution | |
| Ferric Sulfate | 20 g |
| Disodium Ethylenediamine-tetraacetate Dihydrate | 36 g |
| Sodium Carbonate (monohydrate) | 17 g |
| Sodium Sulfite | 5 g |
| Ammonium Thiosulfate (70% aq. soln.) | 100 ml |
| Boric Acid | 5 g |
| pH | 6.8 |
| Water | to 1000 ml |
| Stabilizer | |
| Boric Acid | 5 g |
| Sodium Citrate | 5 g |
| Sodium Metaborate (tetrahydrate) | 3 g |
| Potassium Alum | 15 g |
| Water | to 1000 ml |

Reticulation of the samples were then observed to obtain the results as shown in Table 3.

Table 3

| | Degree of Occurrence of Reticulation |
|---|---|
| Sample | Degree of Occurrence of Reticulation |
| 1 | No Occurrence |
| 2 | " |
| 3 | High Occurrence |

Samples were prepared using protective layers in which gelatin was similarly substituted by Synthetic High Molecular Weight Material D with a substitution proportion by weight of 0, 10%, 20%, 30%, 50% and 70%, processed and then the occurrence of reticulation was observed for these samples. The results as shown in Table 4 were obtained.

Table 4

| Relation of Polymer Substitution and Occurrence of Reticulation | |
|---|---|
| Polymer Substitution | Degree of Occurrence of Reticulation |
| (%) | |
| 0 | High Occurrence |
| 10 | Low Occurrence |
| 20 | No Occurrence |
| 30 | " |
| 50 | " |
| 70 | " |

The results in Table 4 in the case of Synthetic High Molecular Weight Material D are similar to those in the case of Synthetic High Molecular Weight Material E, but, with respect to suppressing the increase of viscosity, Synthetic High Molecular Weight Material D is superior thereto as shown in the Figure.

EXAMPLE 4

An ammonia process silver iodobromide emulsion was prepared in a conventional manner as described below.

| | |
|---|---|
| Component A | |
| Distilled Water | 600 ml |
| Gelatin | 10 g |
| Potassium Bromide | 76 g |
| Potassium Iodide | 1.2 g |
| Component B | |
| Silver Nitrate | 100 g |
| Ammonium Hydroxide (25% aq. soln.) | 90 ml |
| Water | to 200 ml |
| Gelatin | 30 g |
| Component C | |
| Sodium Hydroxide (1N aq. soln.) | 10 ml |
| Potassium Bromide (4% aq. soln.) | 5 ml |
| Distilled Water | 250 ml |
| Synthetic High Molecular Weight Material A | 5 g |

Component B kept at 40° C. was dropwise added to Component A kept at 50° C. with agitation over the course of 15 minutes and then ripened at 50° C. for 30 minutes. Precipitation and desalting were then carried out using a copolymer of potassium p-vinylbenzenesulfonate and acryloylmorpholine (as disclosed in U.S. Pat. No. 3,482,980). Furthermore, Component C was added at 55° C. and the mixture was subjected to chemical ripening using sodium thiosulfate or the sulfur compound described in U.S. Pat. No. 1,574,944 and potassium chloroaurate as a chemical sensitizer.

Then the emulsion layer and the protective layer having the compositions shown in Table 5 were coated onto a polyethylene terephthalate film in this order by the extrusion method and dried at a dry bulb temperature of 25° C. and wet bulb temperature of 20° C. to prepare a sample. Two square sheets of 4 cm×4 cm were cut from each of the thus obtained Samples I to IV, conditioned at a temperature of 35° C. and a relative humidity of 90% for 2 days, in such a manner that the two sheets did not contact each other, then were contacted so that the protective layers faced each other and stored at a temperature of 35° C. and a relative humidity of 90% under a load of 800 g for one day. These sheets were then stripped and the adhered area was measured to assess the adhesion resistance. The results obtained are shown in Table 6.

The evaluation of the adhesion resistance was carried out according to the following scale:

| Rank | Adhered Area |
|---|---|
| | (%) |
| 1 | 40 or less |
| 2 | 41–60 |
| 3 | 61–80 |
| 4 | 81 or more |

Table 5

| | Emulsion Layer | Protective Layer | | | |
|---|---|---|---|---|---|
| | | Sample I | Sample II | Sample III | Sample IV |
| Binder | 2.48 g/m$^2$ (gelatin) | 1.95 g/m$^2$ (gelatin) | 1.95 g/m$^2$(1) | 1.95 g/m$^2$(2) | 1.95 g/m$^2$(3) |
| Silver | 5.00 g/m$^2$ | None | | | |
| Hardener | 2-Hydroxy-4,6-Dichloro-1,3,5-Triazine Sodium Salt (0.5 g/100 g binder) | 2-Hydroxy-4,6-Dichloro-1,3,5-Triazine Sodium Salt (0.4 g/100 g binder) | | | |
| Stabilizer | 1-Phenyl-5-Mercaptotetrazole (0.5 g/100 g binder) | None | | | |
| Coating Aid | None | Saponin: (2 g/100 g binder) G(4) (0.8 g/100 g binder) | | | |
| Matting Agent | None | Silica(5) (15g/100g | None | Silica(5) (1.5g/100g | Silica(5) (1.5g/100g |

-continued

| | | | |
|---|---|---|---|
| | binder) | binder) | binder) |

Note:
(1),(2)Containing 10% of Synthetic High Molecular Weight Material A of the invention in gelatin
(3)Containing 20% of Synthetic High Molecular Weight Material A of the invention in gelatin
(4)Structural Formula of G:$CF_3(CF_2)_7SO_2-N(C_2H_5)-CH_2-COONa$
(5)Silica having an average grain size of 3 microns Table 6

| | Sample | | | |
|---|---|---|---|---|
| | I | II | III | IV |
| Adhesion Resistance | 4 | 3 | 1 | 1 |

It is apparent from the results in Table 6 that adhesion takes place on substantially the entire surface in the case of Sample I having an ordinary gelatin protective layer and the adhesion resistance is not increased very much in the case of Sample II using the high molecular weight material of the invention in the protective layer but not using a matting agent, while, on the contrary, the adhesion resistance is superior in the case of Samples III and IV using the high molecular weight material of the invention with a matting agent. That is to say, the joint use of the high molecular weight material of the invention with a matting agent in a protective layer serves to increase remarkably the adhesion resistance.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive silver halide element having a photographic gelatin-containing layer containing a copolymer of a styrene component, a maleic acid component and an acrylamide component in which the content of the acrylamide component is about 3 to 30 mole% of said copolymer, the content of the maleic acid component is 35 to 50 mol% of said copolymer, said copolymer being present in an amount of from about 3 to 60% by weight of said gelatin and the acrylamide component is represented by the following general formula (I)

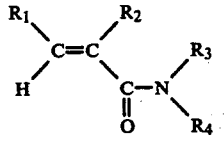

in which $R_1$ and $R_2$, which can be the same or different, each represents a hydrogen atom or a methyl group; and $R_3$ and $R_4$, which can be the same or different, each represents a hydrogen atom or an alkyl group having 1 to 8 carbon atoms or $R_3$ and $R_4$ may combine as the non-metaliceatoms necessary for forming a 5-, 6- or 7-membered ring; the styrene component represented by the following general formula (II)

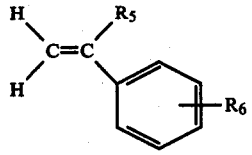

(II)

in which $R_5$ represents a hydrogen atom or a methyl group; and $R_6$ represents a hydrogen atom, an alkyl group having 1 to 4 carbon atoms, an alkoxy group having 1 to 4 carbon atoms, a hydroxyl group, a hydroxymethyl group, a cyano group, a nitro group or a halogen atom; and the said maleic acid component is represented by the following general formula (III)

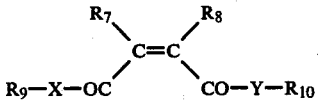

(III)

in which $R_7$ and $R_8$, which can be the same or different, each represents a hydrogen atom, a methyl group, or a phenyl group; $R_9$ and $R_{10}$, which can be the same or different, each represents a hydrogen atom, an alkyl group having 1 to 12 carbon atoms or an aralkyl group; and X and Y, which can be the same or different, each represents —O— or —NH—; and —X—$R_9$ and $R_{10}$—Y can combine together and represent —O—.

2. The photographic light-sensitive material of claim 1, wherein said layer further includes a natural high molecular weight material or a synthetic high molecular weight material other than gelatin as a binder.

3. The photographic light-sensitive material of claim 2, wherein said binder is a saccharide derivative, a cellulose derivative or a protein other than gelatin.

4. The photographic light-sensitive material of claim 1, wherein said layer further includes a binder selected from the group consisting of albumin, agar, hydroxyethyl cellulose or methyl cellulose.

5. The photographic light-sensitive material of claim 1, wherein said layer further includes a binder selected from the group consisting of polyvinyl alcohol, polyacrylamide, poly vinylpyrrolidone, polyacrylic acid, a polyacrylic acid ester or a copolymer thereof.

6. The photographic light-sensitive material of claim 1, wherein said layer further includes a hydrophobic polymer latex.

7. The photographic light-sensitive material of claim 1, wherein said layer further includes a matting agent.

8. The photographic light-sensitive material of claim 7, wherein said matting agent is particles of an inorganic compound or an organic compound.

9. The photographic light-sensitive material of claim 8, wherein said inorganic material is a silver halide, silica, glass beads, zinc carbonate, titanium oxide, strontium barium sulfate, or barium sulfate; and said organic compound is (1) a synthetic high molecular weight material selected from the group consisting of polystyrene, polymethylmethacrylate, polycarbonate, polytetrafluoroethylene, polyvinyl chloride, poly-α-methyl styrene and cellulose acetate propionate, (2) a fatty acid or (3) starch.

10. The photographic light-sensitive material of claim 1, wherein said copolymer is present in an amount of about 5 to 30% by weight of said gellatin.

11. The photographic light-sensitive material of claim 1, wherein the maleic acid component is maleic acid.

12. The photographic light-sensitive material of claim 1, wherein the content of said styrene component is about 20 to 62 mol% of said copolymer.

* * * * *